US005164774A

United States Patent [19]

Tomita et al.

[11] Patent Number: 5,164,774

[45] Date of Patent: Nov. 17, 1992

[54] DEVELOPING DEVICE OF THE TYPE FORMING THIN LAYER OF TONER ON TONER CONVEYING MEMBER, AND DRY COLOR TONER OF ONE COMPONENT TYPE USED THEREIN

[75] Inventors: Masami Tomita, Numazu; Hachiro Tosaka, Shizuoka; Motoi Orihara; Hiroshi Tanaka, both of Numazu; Tomoe Hagiwara, Shizuoka, all of Japan

[73] Assignee: Ricoh Company, Ltd., Tokyo, Japan

[21] Appl. No.: 283,743

[22] Filed: Dec. 13, 1988

[30] Foreign Application Priority Data

Dec. 16, 1987 [JP] Japan ..... 62-316112

[51] Int. Cl.[5] ..... G03G 9/08; G03G 15/01; G03G 15/08

[52] U.S. Cl. ..... 355/245; 355/327; 430/109; 430/111; 430/903

[58] Field of Search ..... 355/245, 326, 327; 430/106, 107, 108, 109, 111, 903

[56] References Cited

U.S. PATENT DOCUMENTS 3,942,979 3/1976 Jones et al. ..... 430/107 X
3,969,251 7/1976 Jones et al. ..... 430/106
4,108,786 8/1978 Takayama et al. ..... 430/903 X
4,122,024 10/1978 Jones et al. ..... 430/111
4,543,312 9/1985 Murakawa et al. ..... 430/903 X
4,615,612 10/1986 Ohno et al. ..... 355/326
4,833,059 5/1989 Tomura et al. ..... 355/259 X

FOREIGN PATENT DOCUMENTS 63-301960 12/1988 Japan .

*Primary Examiner*—Fred L. Braun
*Attorney, Agent, or Firm*—Cooper & Dunham

[57] ABSTRACT

In a developing device and a dry color toner for color electrophotography. The developing device is provided with a toner conveying member and a toner layer thickness controlling member which is in contact with the toner conveying member. The color toner for developing electrostatic images used in this developing device has the following relation between the number average particle diameter and the volume average particle diameter:

$$1.0 \leqq \frac{\text{volume average particle diameter } (\mu m)}{\text{number average particle diameter } (\mu m)} \leqq 1.2$$

Even after a continuous copying, the developing device and the color toner provide substantially the same image quality as that in the earlier stages of the continuous copying.

24 Claims, 4 Drawing Sheets

DEVELOPING DEVICE OF THE TYPE FORMING THIN LAYER OF TONER ON TONER CONVEYING MEMBER, AND DRY COLOR TONER OF ONE COMPONENT TYPE USED THEREIN

BACKGROUND OF THE INVENTION

This invention relates to a developing device of the type in which a thin layer of toner is formed on a toner conveying member and to a one-component type dry color toner to be used in this developing device for the purpose of developing electrostatic images.

The dry developing systems utilized in electrostatic photography, electrostatic recording, etc. may be classified into two types: systems using a two-component type developing agent composed of toner particles and carrier particles and those using a one-component type developing agent containing no carrier particles. A system of the former-type allows to obtain images of satisfactory quality with a relative steadiness. However, it is apt to involve carrier deterioration and variation in the toner/carrier mixing ratio, so that with such a system there is little possibility of obtaining images of constant quality for a long period of time. Besides, it involves a bothersome maintenance work and a rather bulky apparatus. In view of these problems, more and more attention is being paid to the latter-type systems, which are free from these problems, i.e., those systems which use one-component type developing agent.

In a system of the latter type, toner (developing agent) is normally conveyed by means of at least one toner conveying member, an electrostatic image formed on an electrostatic image carrier member being turned into a visual image by means of the toner conveyed. In this case, the toner layer formed on the toner conveying member must be as thin as possible. This also applies to systems using a two-component type developing agent the carrier particle diameter of which is very small. Further, when a toner which exhibits a high electrical resistance is adopted in a system using a one-component type developing agent, in particular, the toner must be charged by means of the developing apparatus, so that the toner layer is required to be extremely thin. When this toner layer is rather thick, only those portions of the toner layer which are near the surface of the toner layer will be charged, resulting in an uneven charging of the toner layer.

In view of this, various means for controlling the thickness of the toner layer formed on the toner conveying member (toner layer thickness controlling means) have been proposed. A typical example of such controlling means may be the one using a doctor blade, which is situated in a position opposite to the toner conveying member. This doctor blade controls the thickness of the toner layer by exerting pressurizing force on the conveyed toner on the surface of the toner conveying member.

While conventional developing devices having such toner layer thickness controlling means as described above allow to obtain satisfactory images in the earlier stages of copying, they involve gradual deterioration in image quality including unevenness in image density. In the case of color copying, in particular, a continuous copying with toner being supplied will involve reduction in the amount of charge which the toner receives, so that a color tone of image obtained in later stage of copying is distinctly different from that of the early copied image.

SUMMARY OF THE INVENTION

An object of this invention is to provide a dry color toner for developing electrostatic images in a system which uses a one-component type developing agent and is adapted to form a thin layer of the toner on a toner conveying member to thereby obtain satisfactory images, in which the dry color toner involves no variations in particle diameter thereof as well as in charging properties thereof to thereby allow to obtain image quality equivalent to that in the earlier stages of copying even after continuous copying.

An another object of this invention is to provide a developing device capable of involving image quality equivalent to that in the earlier stages of copying even after continuous copying operation.

After a continued study conducted with a view to overcoming the problem mentioned above, the inventor has discovered the following. In the case where the toner layer thickness is controlled by pressing with high pressure the toner control means against the surface of the toner conveying member, most of the toner particles contained in the toner layer which has been thus controlled have a relatively small particle diameter, and toner particles having a relatively large particle diameter are not used for the development. As a result, the proportion of the large-diameter toner particles to the small-diameter ones in the developing agent becomes larger and larger. Accordingly, the texture of copy images becomes rougher and rougher as the copying operation is continued. Further, since the toner particle diameter becomes larger, a frictional charging under the same conditions will involve reduction in the charging amount per unit toner weight.

Consequently, in the case of comparing a copy image obtained in the earlier stages of continuous copying operation with a copy image obtained in the later stages of the copying operation, the weight of the toner adhering to an electrostatic image in the later stages becomes greater than that in the earlier stages even if an electric potential of electrostatic image is maintained constant during the continuous copying operation. And the change of weight of toner adhering to the electrostatic image involves variation in the color tone of the copy image. This phenomenon is to be observed not only in the copying of a monochrome original but also of a multi-colored one. When, for example, the area of an image occupied by a certain color is larger than the area related to the other colors, the color toner corresponding to said certain color will be consumed in a greater amount than the other color toners. In this case, particle-diameter selection occurs in the developing chamber with respect to the color toner corresponding to said certain color. As a result, in continuous copying operation, large-diameter color toner particles will remain in larger proposition in the developing chamber as compared with small-diameter color toner particles, whereby the later copy images become different from the earlier copy images in color tone.

The inventor has discovered the fact that variation in the particle-diameter of the toner on the toner conveying member can be restrained when the volume average particle diameter ($\mu$m) / the number average particle diameter ($\mu$m) corresponding to the particle diameter distribution of the toner is kept within a particular range, which led him to the present invention.

This invention is related to a developing device equipped with a toner conveying member and a toner layer thickness controlling member abutting against this toner conveying member as well as to a dry color toner to be used in this developing device for the purpose of developing electrostatic images. This color toner exhibits the following relation between the number average particle diameter and the volume average particle diameter thereof: 1.0≦volume average p.d. (μm)/number average p.d. (μm)≦1.2 (p.d.=particle diameter)

Since this invention allows to restrain variation in the particle diameter of the toner on the toner conveying member, the image quality of earlier images can be retained even after a continuous copying.

Other objects and advantages of the present invention will become apparent from the detailed description with respect to the preferred embodiments shown in the attached drawings.

DESCRIPTION OF THE PREFERRED EMBODIMENTS

Embodiments of this invention will now be described with reference to the attached drawings.

Figure 1:
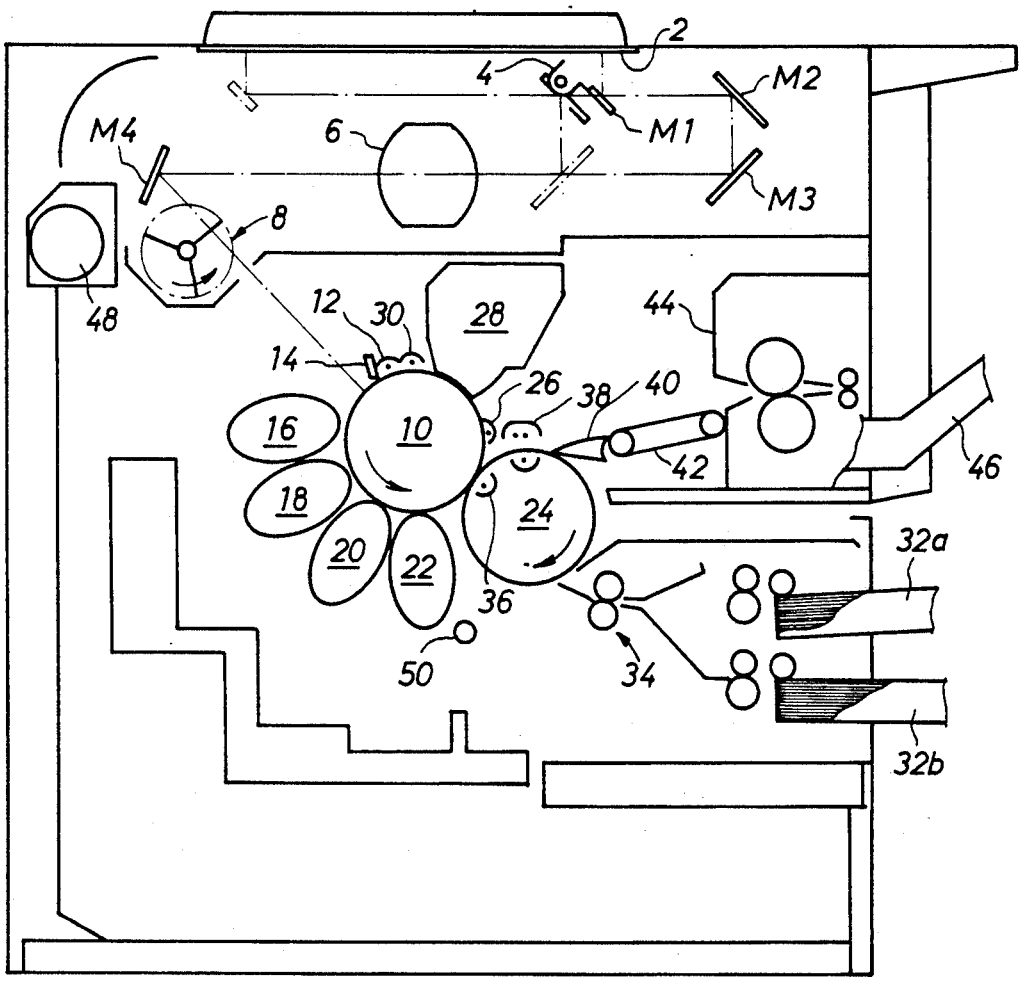
FIG. 1 shows the general construction of a color copying apparatus constituting an example of color image forming apparatuses to which this invention may be applied.

FIG. 1 shows the general construction of a color copying apparatus constituting an example of color image forming apparatuses suited to execution of this invention. The construction of this color copying apparatus being well known, only the principal components thereof will be briefly described.

The reference numeral 2 denotes an original disposition table, on which a color original is disposed. In performing copying, the above color original is illuminated by an illuminator 4. The light reflected by the original is then transferred by way of mirrors M1, M2, M3, M4, a lens 6, a color separation filter 8, etc. to the image area of an electrostatic image carrier member 10 to form an image in the area. In thus forming an image, the illuminator 4, and the mirrors Ml, M2, and M3 are moved, and simultaneously with this movement, the electrostatic image carrier member 10 is rotated, whereby an exposure scanning is effected.

Operated around the electrostatic image carrier member 10 are an electrostatic charger 12, an eraser 14, a black-developing device 16, a yellow-developing device 18, a magenta-developing device 20, a cyan-developing device 22, a transferring member 24, an electrostatic charge remover 26 arranged so as to remove the electrostatic charge from the electrostatic image carrier member 10 before the image carrier member 10 is subjected to cleaning operation, a cleaning device 28, an electrostatic charge remover 30, etc., arranged in this order in the rotational direction of the electrostatic image carrier member 10.

The black-developing device 16, the yellow-developing device 18, the magenta-developing device 20, and the cyan-developing device 22 serve to perform development while using black toner, yellow toner, magenta toner, and cyan toner, respectively.

Prior to the above-mentioned exposure scanning, the electrostatic image carrier member 10 is uniformly charged by the electrostatic charger 12. An electrostatic image is accordingly formed on the electrostatic image carrier member 10 by the exposure scanning. This electrostatic image is then turned into a toner image by the developing device which has the toner of the color corresponding to the color separation filter related to the forming of the electrostatic image concerned, and is transmitted to a transfer member 24.

A transfer paper is previously wound around the transfer member 24. This transfer paper is selected from a paper feeder section **32*a* or 32*b*, in accordance with the size of the original, and is fed on the transfer member 24 through a resist member 34**.

The above-mentioned toner image is transferred to the transfer paper on the transfer member 24 by a transfer section in which a transfer electrostatic charger 36 is arranged. On the other hand, the electrostatic image carrier member 10 which has finished the transfer passes the electrostatic charge remover 26, and then passes the cleaning device 28, where the residual toner thereon is removed by cleaning. The image carrier member 10 is then deprived of the electrostatic charge thereon by the electrostatic charge remover 30 in order to prepare for the next charging.

Then, after the charging, scanning is performed with light passing through a filter which is different from the previous one of the color separation filter 8, and development is performed with the toner of the color corresponding to this filter, a toner image being transferred to the transfer paper on the transfer member 24 in such a manner as to be superimposed on the previous toner image.

By repeating such a process, a desired color image which is a reproduction of the original is synthesized on the transfer paper.

When a color image has been thus formed, the transfer paper carrying the color image is separated from the transfer member 24 by the action of an electrostatic charger 38 which is actuated in separating the transfer paper from the transfer member 24 and a separating claw 40, and is conveyed through a conveyor 42 to a fixing device 44.

After the fixing, the transfer paper is transmitted as a color copy to a paper discharge tray 46.

FIG. 1 also shows an optical fan 48, and an electrostatic charge remover 50 for removing the electrostatic charge from the transfer member 24 before transfer operation is performed on the transfer member 24.

Figure 2:
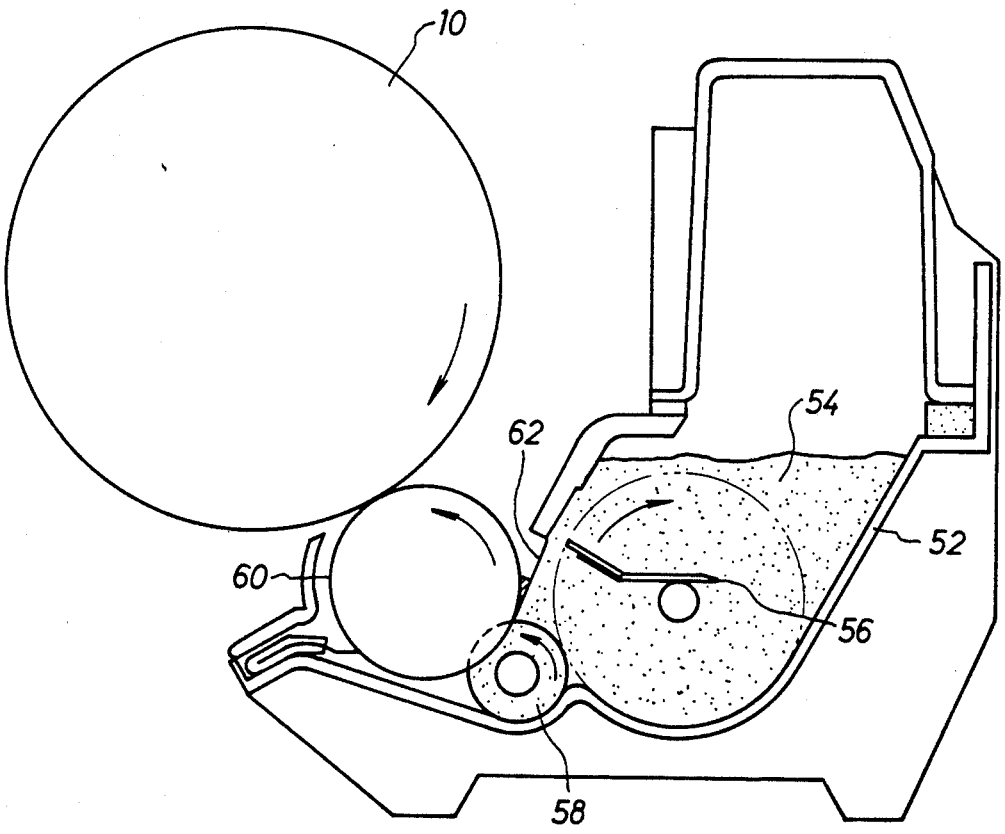
FIG. 2 illustrates the developing method using the toner in accordance with this invention.

Next, it will be described how the developing devices of the above image forming apparatus conduct development of electrostatic images. As shown in FIG. 2, a toner 54 contained in a toner tank 52 is forced to gather around a sponge roller 58 by an agitating blade 56, the toner being thus supplied to the sponge roller 58. The toner which has been thus taken up by the sponge roller 58 is supplied to a toner conveying member 60 due to the rotation of the sponge roller 58 in the direction indicated by the arrow, and is rubbed by the sponge roller 58 to be electrostatically or physically adsorbed by the toner conveying member 60, which strongly rotates in the direction indicated by the arrow. A uniform thin layer of toner is then formed on the toner conveying member 60 by a toner layer thickness controlling member 62, and is frictionally charged. The toner is then transmitted to the surface of the electrostatic image carrier member 10 which is in contact with or in close proximity to the toner conveying member 60, to thereby develop the latent image.

The dry color toner for developing electrostatic images in accordance with this invention satisfies the following relation between the number average particle diameter and the volume average particle diameter: $1.0 \leqq$ volume average p.d. ($\mu$m)/number average p.d. ($\mu$m) $\leqq 1.2$ The toner particle diameter is measured with a Coltar counter Model TA II (manufactured by Coltar Electronics Co.).

When the value in the above formula is larger than 1.2, particle diameter selection occurs in the toner supplied to the toner conveying member, the particle diameter of the toner appearing on the toner conveying member 60 becoming much smaller than that of the toner supplied to the development hopper. Further, as the development is repeated, the toner is consumed by priority of smallness in particle diameter, so that the particle diameter of the toner appearing in the hopper and on the toner conveying member 60 becomes larger and larger. Accordingly, the charging properties of the toner after a continuous copying becomes different from those in the early stages of the copying, so that the image after the continuous copying are accompanied with such a defect on image quality as fog generation, variation in image density, etc. and in the case of a color toner, variation in color tone.

Figure 3:
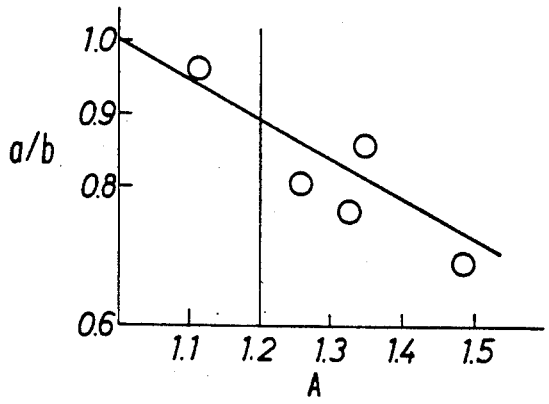
FIG. 3 is a graph showing the relation between the volume average particle diameter/the number average particle diameter A and the volume average particle diameter a (earlier stage) of the toner appearing on the toner conveying member/the volume average particle diameter b of the toner supplied to the developing device.

An examination conducted by the inventor has revealed that the toner particle diameter selection occurs when the toner passes the toner layer thickness controlling member 62. Then, the relation between the volume average particle diameter/the number average particle diameter (A) corresponding to the toner particle diameter distribution and the volume average particle diameter a (in the earlier stages) of the toner appearing on the toner conveying member 60/the volume average particle diameter b of the toner supplied to the developing device (unit for both $\mu$m) was investigated (FIG. 3).

Figure 4:
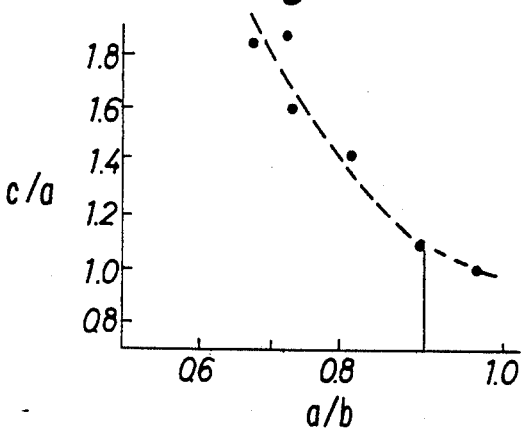
FIG. 4 is a graph showing the relation between the ratio c/a of volume average particle diameter c of the toner appearing on the toner conveying member after a continuous copying (10,000 sheets) to the volume average particle diameter a of the toner appearing on the toner conveying member in the earlier stages of copying and said a/b.

The relation between the ratio of the volume average particle diameter c of the toner appearing on the toner conveying member 60 after a continuous copying (10,000 sheets) to the volume average particle diameter a of the toner appearing on the conveying member 60 in the earlier stages c/a and the above a/b was as shown in FIG. 4.

It will be appreciated from FIG. 4 that when the value of a/b is smaller than 0.9, a great difference is to be observed between the particle diameter of the toner on the toner conveying member 60 in the earlier stages and the particle diameter of the toner on the toner conveying member 60 after a continuous copying.

Consequently, it will be appreciated by applying this value to FIG. 3 that when the value of the volume average particle diameter/the number average particle diameter (A) with respect to the toner used ranges from 1.0 to 1.2, variation in the particle diameter of the toner appearing on the toner conveying member 60 can be restrained, which helps, in the case of a color toner, to prevent variation in color tone of the copy image, as will be described later.

Figure 5:
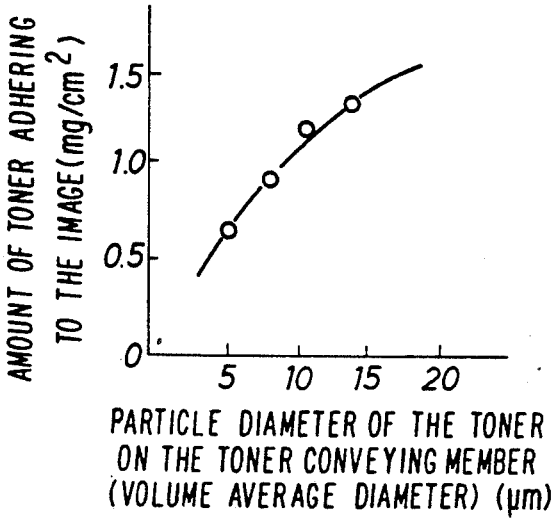
FIG. 5 is a graph showing the relation between the toner particle diameter and the amount of toner adhering to the image.

FIG. 5 shows the relation between the particle diameter of the toner appearing on the toner conveying member 60 into which the one-component type dry color toner is applied and the amount of the toner adhering to the image. It will be appreciated from this figure that when the toner particle diameter is augmented as a result of a continuous copying, the amount of toner adhering to the image will increase.

Next, the relation between the amount of toner adhering to the image and the color tone will be described with respect to the colors of yellow (FIG. 6), magenta (FIG. 7), and cyan (FIG. 8) (This relation is described in detail in GATF Research Progress No. 31 (1957) and No. 81 (1970)). With color tone is meant here hue error. The hue error with respect to, for example, yellow toner is calculated from values of three densities (measured with a densitometer manufactured by Macbeth Co.) obtained by passing the light reflected from the toner image of yellow color through three filters of blue, green and red. The hue errors with respect to magenta and cyan toners are calculated in the same manner as in the case of yellow toner. Supposing, with respect to one color toner, the maximum of these three densities is H, the medium one is M, and the minimum is L, the hue error (%) of the one color toner may be expressed as $[(M-L)/(H-L)] \times 100$.

Figure 6:
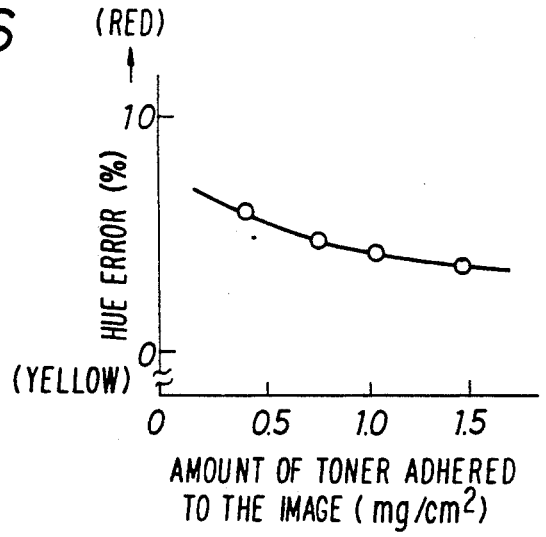
FIGS. 6 through 8 are graphs showing the relation between the toner adhesion amount and the color tone with respect to the toners of yellow, magenta and cyan, respectively.
Figure 7:
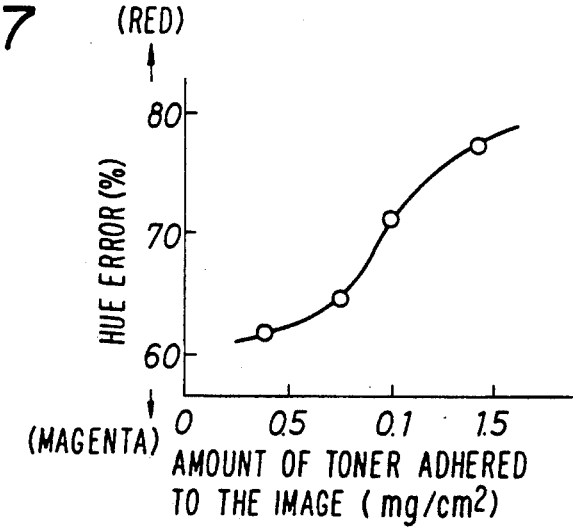
Figure 8:
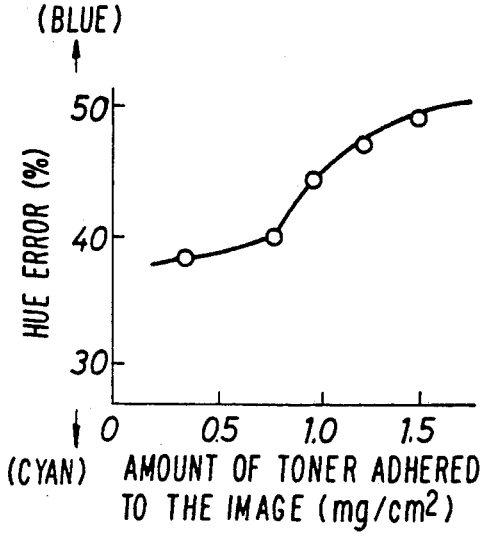

Referring now to FIGS. 6 through 8, it will be appreciated that when the particle diameter of the toner on the toner conveying member 60 is augmented as a result of a continuous copying, the amount of toner adhering to the image and the image density increase, and, in the case of a color toner, variation in color tone of the image occurs to a great extent. This variation in color tone of the image is due to the following fact. While $H=100$ and $M=L=O$ for the ideal yellow, magenta and cyan toners, there exist in reality no such ideal coloring agents. Each toner contains a turbidity component (expressed by $L/H \times 100$) and, as a result the color tone of the image varies as the amount of toner adhering to the image is varied.

Further, the volume average particle diameter of the toner may preferably 3 to 25 $\mu$m.

As to the materials of the toner in accordance with this invention, they may be conventional ones, which are set forth in the following.

For the yellow coloring agent that is used for the yellow toner of this invention, the following may be mentioned: nitro pigments such as naphthol yellow S; organic pigments including azo pigments such as hansa yellow 5G, hansa yellow 3G, hansa yellow G, benzidine yellow GR, benzidine yellow G, and valcanized fast yellow 5G, and inorganic pigments including yellow iron oxide and ocher. As dyes, oil soluble dyes such as C.I. solvent yellow 2, C.I. solvent yellow 6, C.I. solvent yellow 14, C.I. solvent yellow 15, C.I. solvent yellow 16, C.I. solvent yellow 19, and C.I. solvent yellow 21.

For the magenta coloring agent that is used for the magenta toner of this invention, quinaclidon pigments such as C.I. pigment 122 and C.I. pigment 19; rhodamine pigments such as rhodamine 6 G lake and rhodamiee B lake; thioindigo pigments such as C.I. pigment red 87, C.I. vat red 1, and C.I. pigment violet 38; and azo pigments such as brilliant carmine 6 B, and lithol rubin GK, may be mentioned. As dyes, oil soluble dyes such as C.I. solvent red 49, C.I. solvent red 19, and C.I. solvent red 52 may be mentioned.

As for the material of the cyan toner of this invention, pigments including phthalocyanine blue, heliogen blue G, and fast sky blue may be mentioned. As dyes, oil soluble dyes such as C.I. solvent blue 25, C.I. solvent blue 70, and C.I. solvent blue 40 may be mentioned.

As for the black toner, which is used as needed, coloring agents such as carbon black, acetylene black, lamp black, and aniline black may be mentioned.

As the binding resin used for each toner, styrene-type resins (polymers or copolymers including styrene or styrene substitution products) such as polystyrene, chloropolystyrene, poly-alpha-methylstyrene, styrene/-chlorostyrene copolymer, styrene/propylene copolymer, styrene/butadiene copolymer, styrene/vinyl chloride copolymer, styrene/vinyl acetate copolymer, styrene/maleic acid copolymer, styrene/acrylic ester copolymer (styrene/methyl acrylate copolymer, styrene/butyl acrylate copolymer, styrene/octyl acrylate copolymer, styrene/phenyl acrylate copolymer), styrene-methacrylic ester copolymer (styrene/methyl methacrylate, styrene/ethyl methacrylate copolymer, styrene/butyl methacrylate copolymer, styrene/phenyl methacrylate copolymer), stylene-alpha-methyl chloracrylate copolymer, styrene/acrylonitrile/acrylic acid ester copolymer; vinyl chloride resin; rodine denatured maleic resin; phenol resin; epoxy resin; polyester resin; low molecular weight polyethylene; low molecular weight polypropylene; Ionomer resin; polyurethane resin; keton resin; ethylene/ethyl acrylate resin; xylene resin; and polyvinyl butyral, may be used alone or in combination.

The following are generally used as the polar agents for imparting polarity to the toner: a quaternary ammonium compound, a polymer containing amino groups, etc., as the positive polarity agent, and a metal salicylate, etc., as the negative polarity agent. Other substances, however, may be employed as the polar agents.

In addition to the above-mentioned components, various auxiliaries such as plasticizers (dibutyl phthalate, dioctyl phthalate, etc.) and resistance regulators (tin oxide, lead oxide, antimony oxide, etc.) may be added as needed for the purpose of adjusting the thermal properties, the electrical properties, the physical properties, etc., of the toner.

Further, it will be effective in this invention to mix inorganic fine powder of $TiO_2$, $Al_2O_3$, $SiO_2$, SiC, etc. to the toner particles manufactured (5 to 20 μm) for the purpose of coating the surface of the toner particles with the above fine powders, thereby improving the fluidity of the toner, and/or to mix a metal salt of fatty acid, phthalic acid, etc., thereby preventing the photosensitive material from deteriorating.

This invention will now be described with reference to concrete examples.

EXAMPLE 1

5 parts by weight of C.I. pigment yellow 17, 85 parts by weight of styrene-n-butyl methacrylate copolymer, and 10 parts by weight of styrene-dimethylaminomethacrylate copolymer were mixed together to prepare the mixture for the yellow toner. 4 parts by weight of C.I. pigment red 57, 86 parts by weight of styrene-n-butylmethacrylate copolymer, and 10 parts by weight of styrene-dimethylaminomethacrylate copolymer were mixed together to prepare the mixture for the magenta toner. 3 parts by weight of C.I. pigment blue 15, 87 parts by weight of styrene-n-butylmethacrylate copolymer, and 10 parts by weight of styrene-dimethylaminomethacrylate copolymer were mixed together to prepare the mixture for the cyan toner. These mixtures were respectively kneaded under heating in an extruder. The respective kneaded products thus obtained were roughly pulverized by means of a hammer crusher, and the respective pulverized products were finely pulverized by the air-jet method. The respective fine powders thus obtained were classified to obtain yellow, magenta and cyan toners, particle diameters of the respective toners being as follows:

| | Volume a.p.d. (μm) | Volume a.p.d./ Number a.p.d. |
|---|---|---|
| Yellow toner | 10.5 | 1.08 |
| Magenta toner | 10.7 | 1.09 |
| Cyan toner | 10.8 | 1.07 |

(a.p.d. = average particle diameter)

With respect to 100 parts by weight of each toner, 2.5 parts by weight of silicon carbide (with a volume average particle diameter of 2.0 μm), and 0.2 part by weight of fine powder of silica ($SiO_2$) were sufficiently mixed with each other and stirred in a Henschel mixer to prepare each toner.

The toners were supplied to three respective developing devices in the color copying apparatus shown in FIG. 1, and a latent image was prepared by color-separating an original. The latent image was developed with the respective toners and was transferred through a transfer member to a sheet of paper. An image having superimposed three colors was thus obtained, and was passed through a fixing device. As a result, a copy image having a clear color tone was obtained. Further, the image obtained after a continuous copying of 10,000 sheets was quite satisfactory, exhibiting no substantial difference as compared with the images obtained in the earlier stages of the copying.

COMPARISON EXAMPLE 1

Three color toners having respectively the same compositions as those of the color toners in Example 1 and having respectively the following particle diameters were prepared.

| | Volume a.p.d. (μm) | Volume a.p.d./ Number a.p.d. |
|---|---|---|
| Yellow toner | 10.8 | 1.38 |
| Magenta toner | 10.5 | 1.40 |
| Cyan toner | 10.9 | 1.41 |

With respect to 100 parts by weight of each toner, 2.5 parts by weight of silicon carbide (with a volume average particle diameter of 2.0 μm), and 0.2 part by weight of fine powder of silica ($SiO_2$) were sufficiently mixed with each other and stirred in a Henschel mixer to prepare each toner.

The image having superimposed three colors was prepared in the same manner as in Example 1. The thus prepared image was clear in the early stage of continuous copying. However, the image obtained after a continuous copying of 10,000 sheets was distinctly different from the image obtained in the early stage in texture staining, fog generation, etc. due to excessive adhesion of toners to the image.

EXAMPLE 2

8 parts by weight of C.I. pigment yellow 12, 82 parts by weight of styrene-n-butylmethacrylate copolymer, and 10 parts by weight of styrene-dimethylaminomethacrylate copolymer were mixed together to prepare the mixture for the yellow toner. 3 parts by weight of C.I. pigment red 57, 2 parts by weight of C.I. pigment red 81, 85 parts by weight of styrene-n-butylmethacrylate copolymer, and 10 parts by weight of styrene-dimethylaminomethacrylate copolymer were mixed together to prepare the mixture for the magenta toner. 2.5 parts by weight of C.I. pigment blue 15, 0.5 part by weight of C.I. pigment blue 1, 87 parts by weight of styrene-n-butylmethacrylate copolymer, and 10 parts by weight of styrene-dimethylaminomethacrylate copolymer were mixed together to prepare the mixture for the cyan toner. With these three mixtures, the three toners were respectively prepared in the same manner as in Example 1.

The particle diameters of the respective toners were as follows.

| | Volume a.p.d. (μm) | Volume a.p.d./ Number a.p.d. |
|---|---|---|
| Yellow toner | 9.6 | 1.09 |
| Magenta toner | 9.8 | 1.10 |
| Cyan toner | 9.5 | 1.08 |

The same additives as in Example 1 were mixed with the respective toners and an evaluation on the images prepared with these toners was conducted in the same manner as in Example 1. The images obtained were clear, and the image after a continuous copying of 10,000 sheets was satisfactory, exhibiting no substantial difference as compared with the image obtained in the earlier stage.

COMPARISON EXAMPLE 2

Toners of three colors whose compositions were respectively the same as those of the color toners in Example 2 and which had respectively the following particle diameters were prepared.

| | Volume a.p.d. (μm) | Volume a.p.d./ Number a.p.d. |
|---|---|---|
| Yellow toner | 9.8 | 1.33 |
| Magenta toner | 9.6 | 1.35 |
| Cyan toner | 9.7 | 1.34 |

The same additives as in Example 1 were mixed with each toner and an evaluation on the images prepared with these toners was conducted in the same manner as in Example 1. The image obtained in the earlier stage of the copying was clear, but the image obtained after a continuous copying of 10,000 sheets was distinctly different from the image obtained in the earlier stage of the copying in texture staining, fog generation, etc.

COMPARISON EXAMPLE 3

The images were prepared using the following toners in the same manner as in Example 1, and then a similar evaluation to that in Example 1 was conducted on the obtained images. The images obtained in the earlier stages of copying were clear, but the images fogged with cyan color were formed after a continuous copying of 10,000 sheets.

| | |
|---|---|
| Yellow toner | The same yellow toner as in Example 1 |
| Magenta toner | The same magenta toner as in Example 1 |
| Cyan toner | The same cyan toner as in Comparison Example 1 |

COMPARISON EXAMPLE 4

The images were prepared using the following toners in the same manner as in Example 1, and then a similar evaluation to that in Example 1 was conducted on the obtained images. The images obtained in the earlier stages of copying were clear, but the images fogged with magenta color were formed after a continuous copying of 10,000 sheets.

| | |
|---|---|
| Yellow toner | The same yellow toner as in Example 1 |
| Magenta toner | The same magenta toner as in Comparison Example 1 |
| Cyan toner | The same cyan toner as in Example 1 |

COMPARISON EXAMPLE 5

The images were prepared using the following toners in the same manner as in Example 1, and then a similar evaluation to that in Example 1 was conducted on the obtained images. The images obtained in the earlier stages of copying were clear, but the images fogged with yellow color were formed after a continuous copying of 10,000 sheets.

| | |
|---|---|
| Yellow toner | The same yellow toner as in Comparison Example 1 |
| Magenta toner | The same magenta toner as in Example 1 |
| Cyan toner | The same cyan toner as in Example 1 |

The following table shows in detail qualities of the images obtained before and after the continuous copying in the examples and the comparison examples described above.

In the respective copying tests in Examples 1 and 2, and Comparison Examples 1 through 5, an original with a cyan, red, blue, green, and black was used for the first and the 10,000th copying. For the second to the 9,999th copying, a black original was used. By using the originals in this manner, the toner consumption was kept always the same for the yellow, the magenta and the cyan toners, which are separately contained in three toner tanks. The values in the upper and the lower rows of each test in the table indicate the density and the hue error, respectively, of images obtained by copying the original having the seven colors of yellow, magenta, cyan, red, blue, green and black.

| | Number of sheets copied | | | | | | | | | | | | | | |
|---|---|---|---|---|---|---|---|---|---|---|---|---|---|---|---|
| | In the earlier stage (image obtained in the first copying) | | | | | | | After a continuous copying (image obtained in the 10,000th copying) | | | | | | | |
| | Colors of original | | | | | | | | | | | | | | |
| No. | Yellow | Magenta | Cyan | Red | Blue | Green | Black | Yellow | Magenta | Cyan | Red | Blue | Green | Black | Texture staining |
| Example 1 | 0.80 | 1.11 | 1.30 | 1.30 | 1.30 | 1.20 | 1.40 | 0.82 | 1.14 | 1.32 | 1.31 | 1.32 | 1.22 | 1.42 | None |
| | 4 | 68 | 40 | 90 | 50 | 50 | — | 4 | 69 | 41 | 91 | 51 | 48 | — | |
| Example 2 | 0.85 | 1.15 | 1.32 | 1.32 | 1.31 | 1.22 | 1.42 | 0.86 | 1.17 | 1.34 | 1.34 | 1.33 | 1.24 | 1.43 | None |
| | 4 | 67 | 38 | 90 | 50 | 50 | — | 4 | 69 | 39 | 91 | 51 | 48 | — | |
| Comparison | 0.76 | 1.08 | 1.25 | 1.25 | 1.25 | 1.15 | 1.38 | 0.95 | 1.29 | 1.38 | 1.38 | 1.37 | 1.28 | 1.48 | To be |
| Example 1 | 6 | 63 | 37 | 95 | 46 | 55 | — | 3 | 77 | 46 | 85 | 60 | 43 | — | observed |
| Comparison | 0.77 | 1.10 | 1.27 | 1.27 | 1.27 | 1.17 | 1.40 | 0.96 | 1.30 | 1.40 | 1.40 | 1.38 | 1.29 | 1.50 | To be |
| Example 2 | 6 | 62 | 38 | 96 | 45 | 56 | — | 3 | 78 | 46 | 84 | 60 | 45 | — | observed |
| Comparison | 0.80 | 1.11 | 1.25 | 1.30 | 1.25 | 1.16 | 1.38 | 0.82 | 1.14 | 1.39 | 1.31 | 1.39 | 1.29 | 1.46 | Some |
| Example 3 | 4 | 68 | 37 | 90 | 52 | 53 | — | 4 | 69 | 46 | 91 | 60 | 40 | — | |
| Comparison | 0.80 | 1.08 | 1.30 | 1.27 | 1.28 | 1.20 | 1.38 | 0.82 | 1.30 | 1.32 | 1.37 | 1.35 | 1.23 | 1.45 | Some |
| Example 4 | 4 | 63 | 40 | 88 | 48 | 50 | — | 4 | 78 | 41 | 96 | 66 | 47 | — | |
| Comparison | 0.76 | 1.11 | 1.30 | 1.28 | 1.30 | 1.16 | | 0.94 | 1.14 | 1.32 | 1.38 | 1.32 | 1.27 | 1.44 | Some |
| Example 5 | 6 | 68 | 40 | 95 | 50 | 47 | — | 3 | 69 | 42 | 86 | 52 | 55 | — | |

Upper row: Image density (Measured with a Macbeth densitometer)
Lower row: Hue error (%) (Measured with a Macbeth densitometer)

What is claimed is:

1. A dry color toner used in a developing device provided with a toner conveying member and a member disposed in contact with the toner conveying member for controlling thickness of a toner layer on the toner conveying member, the color toner being of such one component type as to contain no carrier particles, the color toner having the following relation between the number average particle diameter and the volume average particle diameter:

$$1.0 \leqq \frac{\text{volume average particle diameter } (\mu m)}{\text{number average particle diameter } (\mu m)} \leqq 1.2$$

2. A color toner according to claim 1, in which the volume average particle diameter of the color toner ranges from 3 to 25 μm.

3. A color toner according to claim 2, in which the color toner comprises 3 to 8 parts by weight of a coloring agent and 92 to 97 parts by weight of a binding agent.

4. A color toner according to claim 3, in which the color. toner is coated on surfaces of particles thereof with inorganic fine powders in the proportion of 2.7 parts by weight of the inorganic fine powders to 100 parts by weight of the color toner.

5. A color toner according to claim 4, in which the inorganic fine powders comprise fine powders of silicon carbide having a volume average particle diameter of 2.0 μm and fine powders of silica.

6. A color toner according to claim 3, in which the binding agent comprises a binding resin.

7. A color toner according to claim 6, in which the binding resin comprises substantially 90 parts by weight of styrene-n-butylmethacrylate copolymer and 10 parts by weight of styrene-dimethylaminomethacrylate copolymer.

8. A color toner according to claim 3, in which the coloring agent comprises a yellow coloring agent.

9. A color toner according to claim 3, in which the coloring agent comprises a magenta coloring agent.

10. A color toner according to claim 3, in which the coloring agent comprises a cyan coloring agent.

11. Dry color toners of at least yellow, magenta and cyan colors used in developing devices corresponding to the respective color toners and provided respectively with a toner conveying member and a member disposed in contact with the toner conveying member for controlling thickness of a toner layer on the toner conveying member, the color toners being of such one component type as to contain no carrier particles, the color toners having the following relation between the number average particle diameter and the volume average particle diameter;

$$1.0 \leqq \frac{\text{volume average particle diameter } (\mu m)}{\text{number average particle diameter } (\mu m)} \leqq 1.2$$

12. Color toners according to claim 11, in which the volume average particle diameters of the color toners range from 3 to 25 μm.

13. Color toners according to claim 12 in which the color toners comprise 3 to 8 parts by weight of a coloring agent and 92 to 97 parts by weight of a binding agent.

14. Color toners according to claim 13, in which the color toner is coated on surfaces of particles thereof with inorganic fine powders in the proportion of 2.7 parts by weight of the inorganic fine powders to 100 parts by weight of the color toner.

15. Color toners according to claim 14, in which the inorganic fine powders comprise fine powders of silicon carbide having a volume average particle diameter of 2.0 μm and fine powders of silica.

16. Color toners according to claim 13, in which the binding agent comprises a binding resin.

17. Color toners according to claim 16, in which the binding resin comprises substantially 90 parts by weight of styrene-n-butylmethacrylate copolymer and 10 parts by weight of styrene-dimethylaminomethacrylate copolymer.

18. A developing device for electrophotography, comprising an electrostatic image carrier member, a toner conveying member situated in close vicinity to the electrostatic image carrier member so as to convey a toner to the image carrier member, and a toner layer thickness controlling member which is so constructed as to form a thin layer of the toner on a surface of the conveying member by pressing the toner supplied to the conveying member against the surface of the conveying member, the toner being of such one component type as to contain no carrier particles, the toner exhibiting the following relation between the number average particle diameter thereof and the volume average particle diameter thereof:

$$1.0 \leqq \frac{\text{volume average particle diameter } (\mu m)}{\text{number average particle diameter } (\mu m)} \leqq 1.2$$

19. A developing device according to claim 18, in which the toner has the volume average particle diameter of 3 to 25 μm.

20. A developing device according to claim 18, in which the toner comprises one sort of color toner selected from a group consisting of a yellow toner, a magenta toner, and a cyan toner.

21. A developing device according to claim 18, in which the electrostatic image carrier member comprises a rotatably arranged cylindrical drum, the toner conveying member comprises a cylindrical roller rotatably arranged in close vicinity to the cylindrical drum and in parallel with an axis of the cylindrical drum, the toner layer thickness controlling member comprising a doctor blade arranged in parallel with an axis of the cylindrical roller and in contact with a surface of the cylindrical roller.

22. A developing device for color electrophotography, comprising an electrostatic image carrier member and at least three developing means spaced apart from each other and in close vicinity to said electrostatic image carrier member for respectively containing at least yellow, magenta, and cyan toners, each of the developing means being provided with a toner conveying member arranged in close vicinity to the electrostatic image carrier member so as to convey a color toner contained in corresponding developing means to the image carrier member and a toner layer thickness controlling member which is so constructed as to form a thin layer of the color toner on a surface of the toner conveying member against the surface of the toner conveying member, the color toner being of such one component type as to contain no carrier particles, the color toner exhibiting the following relation between the number average particle diameter and the volume average particle diameter:

$$1.0 \leqq \frac{\text{volume average particle diameter } (\mu m)}{\text{number average particle diameter } (\mu m)} \leqq 1.2$$

23. A developing device according to claim 22, in which the color toner has the volume average particle diameter of 3 to 25 μm.

24. A developing device according to claim 22, in which the electrostatic image carrier member comprises a rotatably arranged cylindrical drum, the toner conveying member comprises a cylindrical roller rotatably arranged in parallel with an axis of the cylindrical drum and in close vicinity to the cylindrical drum, the color toner layer thickness controlling member comprising a doctor blade arranged in parallel with an axis of the cylindrical roller and in contact with a surface of the cylindrical roller.

* * * * *

UNITED STATES PATENT AND TRADEMARK OFFICE

CERTIFICATE OF CORRECTION

PATENT NO. : 5,164,774

DATED : 11/17/92

INVENTOR(S) : Masami TOMITA et al.

It is certified that error appears in the above-identified patent and that said Letters Patent is hereby corrected as shown below:

Col. 14, line 7, between "member" and "against" insert -- by pressing the color toner supplied to the toner conveying member --.

Signed and Sealed this

Ninth Day of November, 1993

Bruce Lehman

*Attest:*

BRUCE LEHMAN

*Attesting Officer*

*Commissioner of Patents and Trademarks*